US009343852B2

(12) United States Patent
Naito

(10) Patent No.: US 9,343,852 B2
(45) Date of Patent: May 17, 2016

(54) CONNECTOR

(71) Applicant: JAPAN AVIATION ELECTRONICS INDUSTRY, LIMITED, Tokyo (JP)

(72) Inventor: Takeharu Naito, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 14/630,189

(22) Filed: Feb. 24, 2015

(65) Prior Publication Data

US 2015/0303627 A1 Oct. 22, 2015

(30) Foreign Application Priority Data

Apr. 21, 2014 (JP) ..... 2014-087500

(51) Int. Cl.

| | |
|---|---|
| ***H01R 13/648*** | (2006.01) |
| ***H01R 13/70*** | (2006.01) |
| ***H01R 12/72*** | (2011.01) |
| ***H01H 13/702*** | (2006.01) |
| *H01R 13/6594* | (2011.01) |

(52) U.S. Cl.

CPC ..... *H01R 13/701* (2013.01); *H01H 13/702* (2013.01); *H01R 12/725* (2013.01); *H01H 2215/004* (2013.01); *H01H 2223/003* (2013.01); *H01R 13/6594* (2013.01)

(58) Field of Classification Search

CPC ..... H01R 13/701; H01R 13/6594; H01H 13/702; H01H 2215/004; H01H 2223/003

USPC ..... 439/607.27, 607.19, 607.17, 607.4, 439/607.35, 188, 489

See application file for complete search history.

(56) References Cited

U.S. PATENT DOCUMENTS

| | | | | |
|---|---|---|---|---|
| 6,056,590 | A * | 5/2000 | Takahashi | H01R 13/641 439/188 |
| 7,029,318 | B2 * | 4/2006 | Yu | H01R 13/641 439/188 |
| 7,749,007 | B1 * | 7/2010 | Gilliam | H01R 13/53 439/188 |
| 8,814,460 | B2 * | 8/2014 | Ingvast | F16C 1/101 403/301 |
| 2007/0238358 | A1 * | 10/2007 | Akino | H01R 9/0518 439/607.17 |
| 2008/0050935 | A1 * | 2/2008 | Tsuji | H01R 13/4538 439/36 |

(Continued)

FOREIGN PATENT DOCUMENTS

JP 2011142078 A 7/2011

*Primary Examiner* — Abdullah Riyami
*Assistant Examiner* — Nelson R Burgos-Guntin
(74) *Attorney, Agent, or Firm* — Muncy, Geissler, Olds & Lowe, P.C.

(57) ABSTRACT

A connector includes a connector housing having a mating connector receiving portion adapted to receive a mating connector, a plurality of signal contacts each having a connector contact portion formed at one end thereof and disposed in the mating connector receiving portion of the connector housing, a metal shell disposed to cover at least the connector contact portion of each of the plurality of signal contacts, a switch contact having a switch contact portion formed thereon, and a switch member connected to the metal shell and disposed facing the switch contact portion of the switch contact, the switch member being deformed, when pressed, to come into contact with the switch contact portion of the switch contact and thereby connect the switch contact with the metal shell.

10 Claims, 5 Drawing Sheets

(56) References Cited

U.S. PATENT DOCUMENTS

2009/0042426 A1* 2/2009 Kramer ..... H04R 25/65 439/188
2011/0165796 A1 7/2011 Riemeijer et al.
2014/0141641 A1* 5/2014 De Dios Martin ... H01R 13/633 439/358
2014/0273637 A1* 9/2014 Beak ..... H01R 13/7132 439/620.21
2015/0303627 A1* 10/2015 Naito ..... H01R 13/701 439/607.27

* cited by examiner

CONNECTOR

BACKGROUND OF THE INVENTION

The present invention relates to a connector, and more particularly, to a connector which is mounted on a substrate and fitted to a mating connector.

Conventionally, electronic devices such as mobile devices and information devices have been widely used. However, such an electronic device is often provided with a connector through which the electronic device is connected to an external apparatus for sending and receiving signals to and from the external apparatus, and with a so-called tactile switch which is actuated with an operator's finger to input electric signals to the electronic device so as to cause the device to execute various operations.

In general, a connector is fitted to a mating connector which is connected to an external apparatus, to transmit signals. In order to prevent the electric signals transmitted through the connector from being affected by electromagnetic waves from outside, a connector with an electromagnetic shielding effect is desirable.

In addition, due to a recent trend in which thinner electronic devices and larger display screens are more desirable, such connectors and tactile switches are often installed in the periphery of the display screen. In this regard, the mounting space needs to be reduced.

Under these circumstances, JP 2011-142078 A, for example, discloses a connector with a built-in switch. In this connector, as illustrated in FIG. 9, a connector body 2 is disposed on a surface of a substrate 1, and ends of a shell 3 covering the connector body 2 are fixed by soldering to pads 4 of the substrate 1, and the connector is configured so that a jack 5 as a mating connector may be fitted. Inside the connector body 2, contacts 6 which come into contact with a contact portion of the jack 5 are disposed. The shell 3 is partially cut by punching to obtain a cut piece as a switch contact 7. Adjacently to a free end 7*a* of the switch contact 7, another contact 8 is disposed.

As illustrated in FIG. 10, the contact 8 is disconnected from the shell 3, and has a tip section 8*a* overhanging into a jack receiving portion 9 of the connector body 2. When the jack 5 is inserted into the jack receiving portion 9, the tip section 8*a* of the contact 8 is lifted by the jack 5 and comes into contact with the free end 7*a* of the switch contact 7. In this way, the switch for detecting a fitting status of the jack 5 is formed.

According to the connector described in JP 2011-142078 A, shielding can be provided by the shell 3, and because the switch for detecting the fitting status of the jack 5 is built in the connector, the mounting space becomes smaller than in a case where the connector and the switch are separately disposed.

It, however, is not possible with the connector described in JP 2011-142078 A that various operations are carried out by the actuation with an operator's finger irrespective of the fitting of the jack 5. Supposing that a tactile switch, such as a press button switch which is actuated with an operator's finger irrespective of the fitting of a mating connector, is to be installed on an electronic device, the tactile switch needs to be provided as a separate component, independently of the connector, which requires a larger mounting space.

SUMMARY OF THE INVENTION

The present invention has been made to solve the above-mentioned problems with the prior art and an object thereof is to provide a connector which has an electromagnetic shielding effect, is capable of also serving as a tactile switch to be actuated with an operator's finger, and can minimize the mounting space.

A connector according to the present invention comprises:

a connector housing having a mating connector receiving portion adapted to receive a mating connector;

a plurality of signal contacts each having a connector contact portion formed at one end thereof and disposed in the mating connector receiving portion of the connector housing;

a metal shell disposed to cover at least the connector contact portion of each of the plurality of signal contacts;

a switch contact having a switch contact portion formed thereon; and a switch member formed of a conductive material, connected to the metal shell, and disposed facing the switch contact portion of the switch contact, the switch member being deformed, when pressed, to come into contact with the switch contact portion of the switch contact and thereby bring the switch contact into conduction with the metal shell, wherein the metal shell, the switch contact, and the switch member constitute a press button switch.

DETAILED DESCRIPTION OF THE INVENTION

Figure 1A:
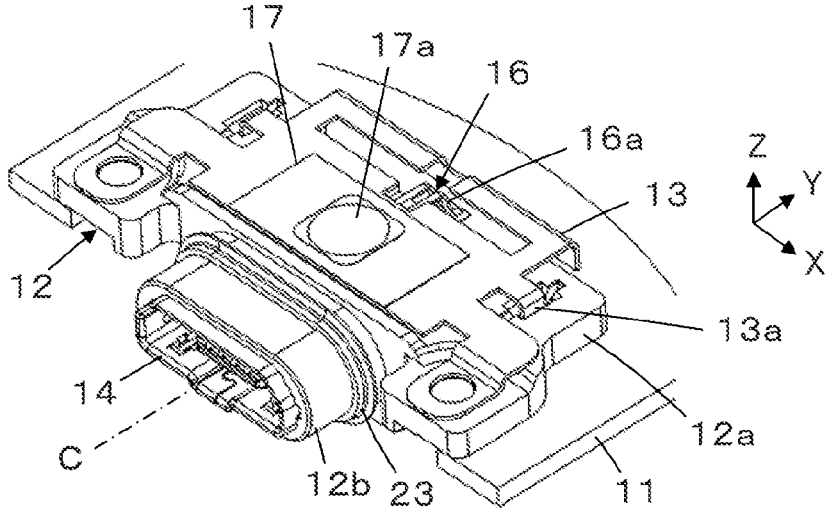
FIGS. 1A-1D are a perspective view, a plan view, a front view and a side view illustrating a connector according to Embodiment 1 of the present invention, respectively.
Figure 1B:
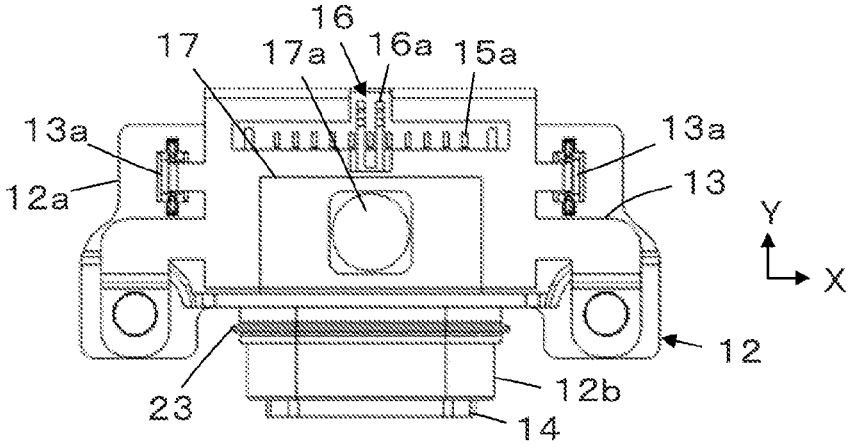
Figure 1C:
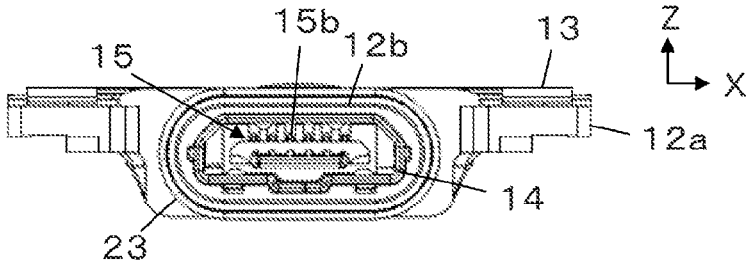
Figure 1D:
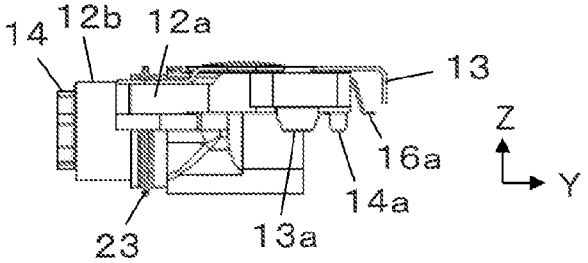

Hereinafter, embodiments of the present invention will be described with reference to the accompanying drawings.

Embodiment 1

FIGS. 1A-1D illustrate a configuration of a connector according to Embodiment 1 of the present invention. This connector constitutes a receptacle to be disposed on a substrate 11, and when fitted to a not shown plug, as a mating connector, along a fitting axis C, provides connection to an external apparatus through the plug. For convenience' sake, the plane in which the surface of the substrate 11 extends is called the XY plane, the direction in which a mating connector is inserted along the fitting axis C is called the +Y direction, and the direction which is perpendicular to the XY plane is called the Z direction.

The connector has a connector housing 12 formed of an insulating material such as a resin. The connector housing 12 has a plate section 12*a* which is disposed on the substrate 11 and extends along the XY plane, and a mating connector receiving portion 12*b* of a tubular shape, which protrudes in the −Y direction from the plate section 12*a* along the fitting axis C. An outer shell 13 is so disposed as to cover the major part of the surface of the plate section 12*a* that is opposite from the substrate 11, and an inner shell 14 of a tubular shape is disposed along an inner periphery of the tubular mating connector receiving portion 12*b*.

The outer shell 13 has a pair of protrusions 13*a*, each extending in the −Z direction through the plate section 12*a* of the connector housing 12 toward the substrate 11. Also, at both X direction ends of a terminal part of the inner shell 14 in the +Y direction, a pair of protrusions 14*a*, each extending in the −Z direction, are formed. These protrusions 13*a* and 14*a* are fixed by soldering to the substrate 11 to allow the connector housing 12, the outer shell 13, and the inner shell 14 to be integrally fixed to the substrate 11.

A plurality of signal contacts 15, each extending in the Y direction, are held by the connector housing 12. Substrate-mounting portions 15*a* formed at the +Y direction ends of the signal contacts 15 protrude in the +Y direction from the connector housing 12. At the −Y direction ends of the signal contacts 15, connector contact portions 15*b* are formed. The connector contact portions 15*b* are arranged in the X direction inside the mating connector receiving portion 12*b* of the connector housing 12, and are surrounded by the inner shell 14.

Between the outer shell 13 and the connector housing 12, a single switch contact 16, which is independent of the plural signal contacts 15, is disposed. A pair of substrate-mounting portions 16*a* formed at the +Y direction end of the switch contact 16 by branching the contact 16 into two parts protrude from the connector housing 12 in the +Y direction.

An insulator seal 17 of a rectangular shape is attached to a surface of a central part of the outer shell 13. A switch area 17*a* of a circular shape indicating the section of a press button switch that is to be depressed is located in the center of the insulator seal 17. Directly under this switch area 17*a*, a switch member 19 and a switch contact portion 16*b* formed at the −Y direction end of the switch contact 16, both to be described later, are located.

Figure 2:
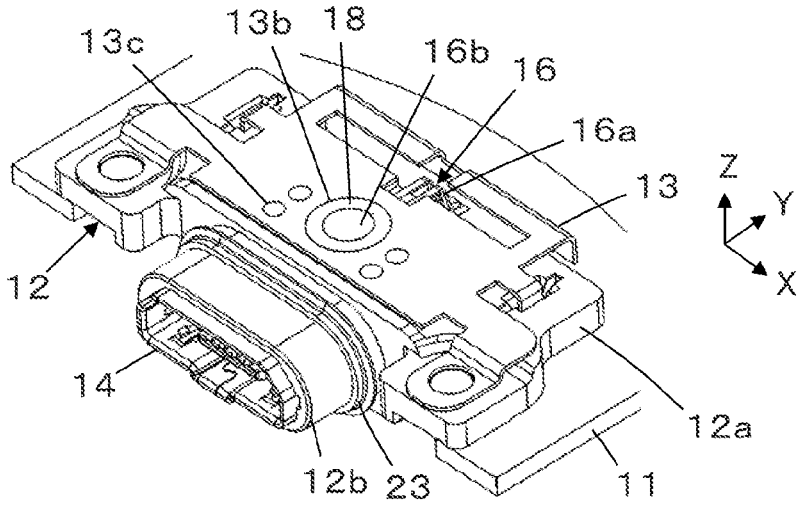
FIG. 2 is a perspective view illustrating the connector of Embodiment 1 from which an insulator seal and a switch member have been removed.

FIG. 2 illustrates a configuration in which the insulator seal 17 and the switch member have been removed. On an inner surface of the outer shell 13, that is, on its surface facing in the −Z direction, a switch contact support member 18 formed of an insulating resin is fixed, and the switch contact 16 is supported by the switch contact support member 18. In the central part of the outer shell 13, a circular opening 13*b* is formed. Inside the opening 13*b*, the switch contact portion 16*b*, which is formed at the −Y direction end of the switch contact 16 and is circular in shape, is disposed.

The switch contact portion 16*b* of the switch contact 16 is concentric with the opening 13*b* of the outer shell 13, and has a diameter smaller than the diameter of the opening 13*b*. A part of the switch contact support member 18 is exposed in the periphery of the switch contact portion 16*b*, allowing the outer shell 13 and the switch contact portion 16*b* to be insulated from each other. In addition, the periphery of the opening 13*b* of the outer shell 13, the exposed part of the switch contact support member 18, and the switch contact portion 16*b* of the switch contact 16 are located on the same plane.

Such configuration of the outer shell 13, the switch contact 16, and the switch contact support member 18 is achieved by using an insulating resin to mold the switch contact support member 18 by insert molding along with the outer shell 13 and the switch contact 16.

It should be noted that, as illustrated in FIG. 2, a plurality of small holes 13*c* are formed through the outer shell 13 in the vicinity of the opening 13*b* and the inside of each of these holes 13*c* is also filled with an insulating resin to form the switch contact support member 18, so that the switch contact support member 18 is firmly fixed to the outer shell 13.

Figure 3:
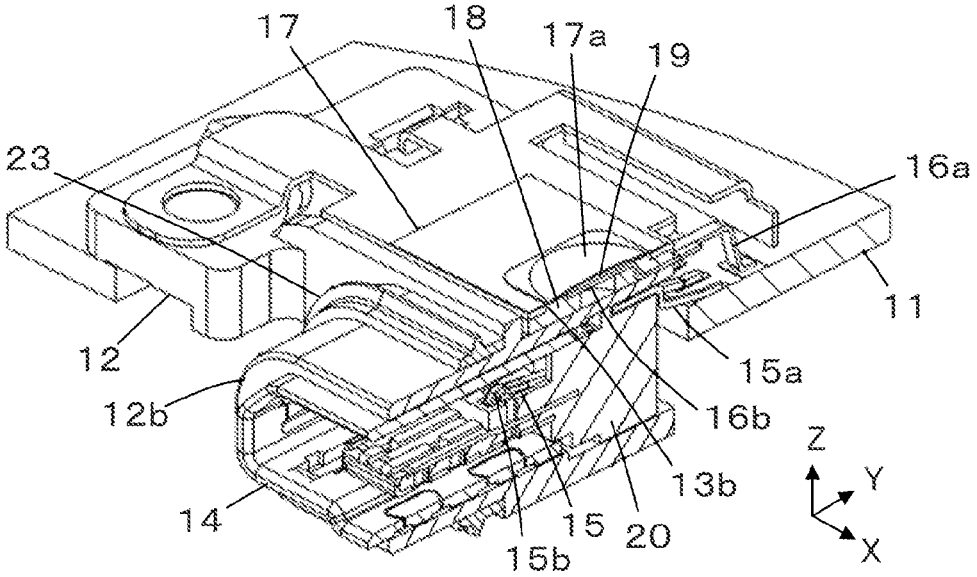
FIG. 3 is a partially broken perspective view illustrating the connector of Embodiment 1.
Figure 4A:
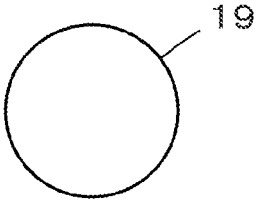
FIGS. 4A and 4B are a plan view and a side view illustrating a switch member used in the connector of Embodiment 1, respectively.
Figure 4B:
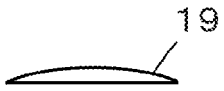

As illustrated in FIG. 3, a switch member 19 formed of a conductive material is so disposed as to cover the opening 13*b* of the outer shell 13, and the insulator seal 17 is attached onto the switch member 19 as well as the outer shell 13 in the vicinity of the opening 13*b*. The switch member 19 has a dome shape as illustrated in FIGS. 4A and 4B, has a diameter slightly larger than the diameter of the opening 13*b* of the outer shell 13, is elastically deformable, and is connected to the outer shell 13 in the periphery of the opening 13*b*.

Because the periphery of the opening 13*b* of the outer shell 13 and the switch contact portion 16*b* of the switch contact 16 are located on the same plane, as described above, and the switch member 19 has a dome shape, if no external force is applied, the switch member 19 is separated from the switch contact portion 16*b*, though the switch member 19 faces the switch contact portion 16*b*. Thereby the switch member 19 and the switch contact portion 16*b* are electrically disconnected from each other.

As such, the outer shell 13, the switch contact 16, and the switch member 19 constitute a press button switch, that is, a tactile switch electrically connectable/disconnectable by an operator actuating the switch with his/her finger while obtaining a click feeling.

The signal contacts 15 are supported by a signal contact support member 20 formed of an insulating material such as a resin, and the signal contact support member 20 is fixed in the mating connector receiving portion 12*b* of the connector housing 12, so that the connector contact portions 15*b* of the signal contacts 15 are disposed inside the mating connector receiving portion 12*b* of the connector housing 12 with the connector contact portions 15*b* being covered by the inner shell 14.

Figure 5:
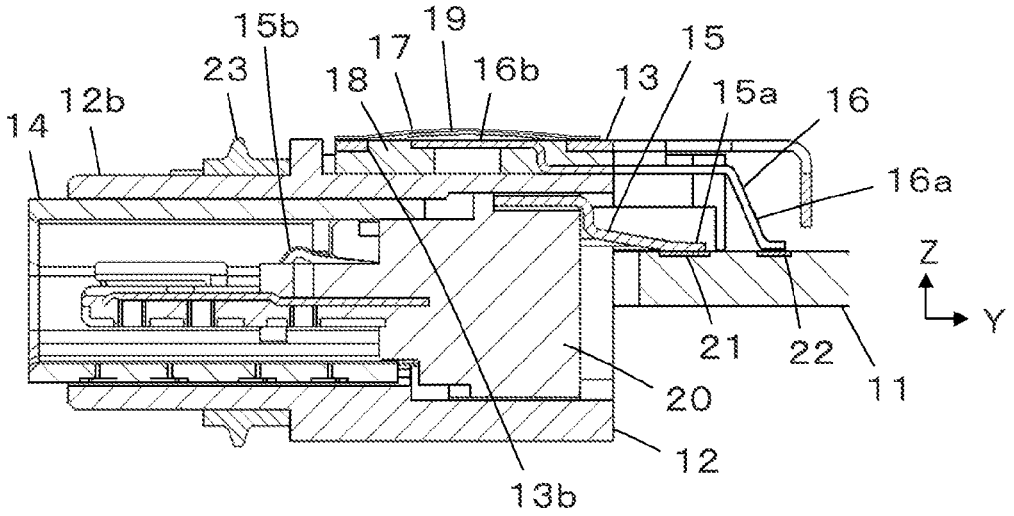
FIG. 5 is a cross-sectional view illustrating the connector of Embodiment 1.

As illustrated in FIG. 5, on the surface of the substrate 11, a plurality of signal pads 21 corresponding the plural signal contacts 15 are formed in an arranged manner. The substrate-mounting portion 15*a* of each signal contact 15 is connected by soldering to the corresponding signal pad 21. Similarly, on the surface of the substrate 11, a switch pad 22 corresponding to the switch contact 16 is formed, and the pair of substrate-mounting portions 16*a* of the switch contact 16 are connected by soldering to the switch pad 22.

It should be noted that a ring-shaped waterproofing member 23 formed of rubber or the like is disposed in an outer periphery of the tubular mating connector receiving portion 12*b* of the connector housing 12.

Figure 6:
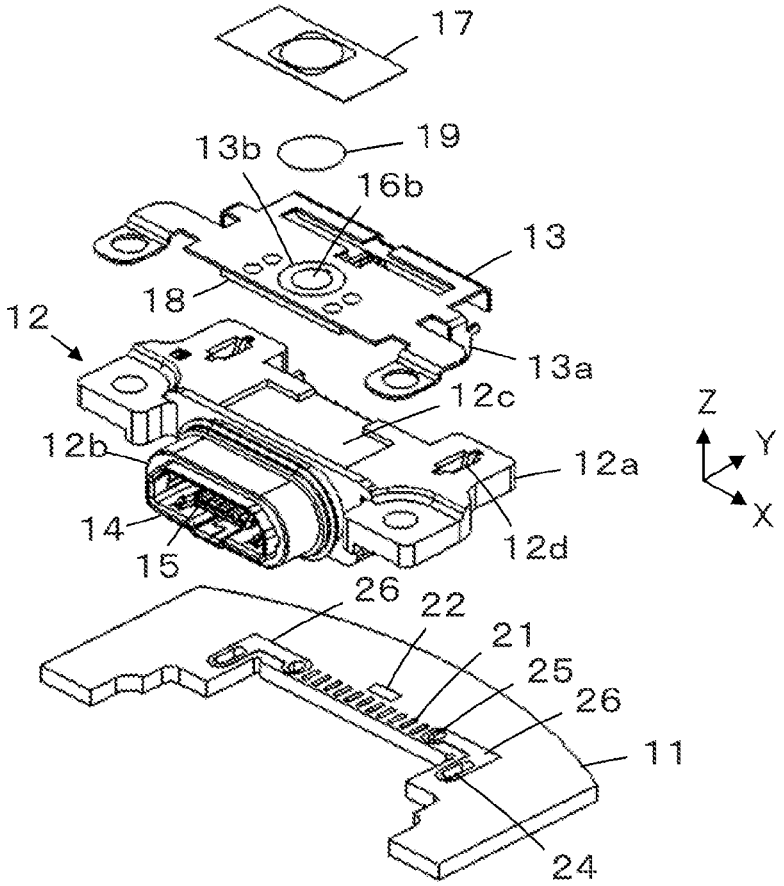
FIG. 6 is an exploded view illustrating the connector of Embodiment 1.

The connector of such configuration is assembled, as illustrated in FIG. 6, by: placing the plate section 12*a* of the connector housing 12, in which the inner shell 14 and the signal contacts 15 are incorporated, on the surface of the substrate 11; disposing the outer shell 13 including the switch contact support member 18 as molded with the switch contact 16 on the connector housing 12; covering the opening 13*b* of the outer shell 13 with the switch member 19; connecting the switch member 19 to the periphery of the opening 13*b*; and attaching the insulator seal 17 onto the switch member 19 as well as the outer shell 13 in the vicinity of the opening 13*b*.

During the assembly, the switch contact support member 18 which is located on the lower side (side facing in the −Z direction) of the outer shell 13 is fitted into a recess 12*c* formed in the upper surface of the plate section 12*a* of the connector housing 12, and the pair of protrusions 13*a* of the outer shell 13, as passing, in the Z direction, through a pair of holes 12*d* formed in the plate section 12*a* of the connector housing 12, are inserted into corresponding through-holes 24 of the substrate 11 and the pair of protrusions 14*a* of the inner shell 14 are inserted into corresponding through-holes 25 of the substrate 11. The through-holes 24 and 25 which are adjacent to each other are connected together through a grounding pattern 26 formed on the surface of the substrate 11.

The protrusions 13*a* and 14*a* are soldered to the corresponding through-holes 24 and 25, respectively, so that the connector housing 12, the outer shell 13, and the inner shell 14 are integrally fixed to the substrate 11, and the outer shell 13 and the inner shell 14 are electrically grounded through the grounding patterns 26.

In addition, the substrate-mounting portions 15*a* of the signal contacts 15 are soldered to the corresponding signal pads 21 of the substrate 11, and the pair of substrate-mounting portions 16*a* of the switch contact 16 are soldered to the switch pad 22 of the substrate 11.

The periphery of the opening 13*b* of the outer shell 13 and the switch member 19 may be connected together by bonding with a conductive adhesive.

Alternatively, the insulator seal 17 may be attached from the top of the switch member 19, which is located covering the opening 13*b* of the outer shell 13, to the vicinity of the opening 13*b* so that the switch member 19 may be brought into contact with the periphery of the opening 13*b* of the outer shell 13. In that case, the switch member 19 and the outer shell 13 are not bonded indeed to each other. Upon switch operation, however, the switch member 19 is depressed in the −Z direction, that is, depressed against the outer shell 13 through the insulator seal 17, which causes a large contact pressure between the switch member 19 and the outer shell 13, allowing the switch member 19 to be connected to the outer shell 13.

When a not shown mating connector is inserted into the mating connector receiving portion 12*b* of the connector housing 12 from the −Y direction along the fitting axis C, connector contact portions of a plurality of contacts of the mating connector come into contact with the connector contact portions 15*b* of the signal contacts 15, allowing signal and power source transfer between the connector according to Embodiment 1 and the mating connector.

At this time, the connector contact portions 15*b* of the signal contacts 15 are covered by the inner shell 14 inside the mating connector receiving portion 12*b* of the connector housing 12, while the outer shell 13 is disposed above (i.e., apart in the +Z direction from) the middle parts of the signal contacts 15, which are supported by the signal contact support member 20, and the substrate-mounting portions 15*a* of the signal contacts 15, which are fixed by soldering to the signal pads 21 of the substrate 11, such that it hangs over the middle parts and substrate-mounting portions, with the outer shell 13 and the inner shell 14 being electrically grounded through the grounding patterns 26. Consequently, an excellent shielding effect is achieved against electromagnetic waves.

Figure 7A:
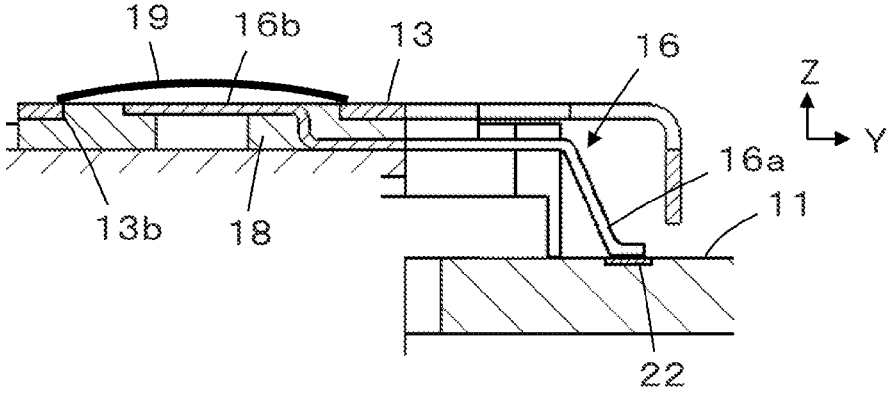
FIG. 7A is a partially enlarged cross-sectional view illustrating the connector of Embodiment 1, in which a press button switch is in the OFF state.
Figure 7B:
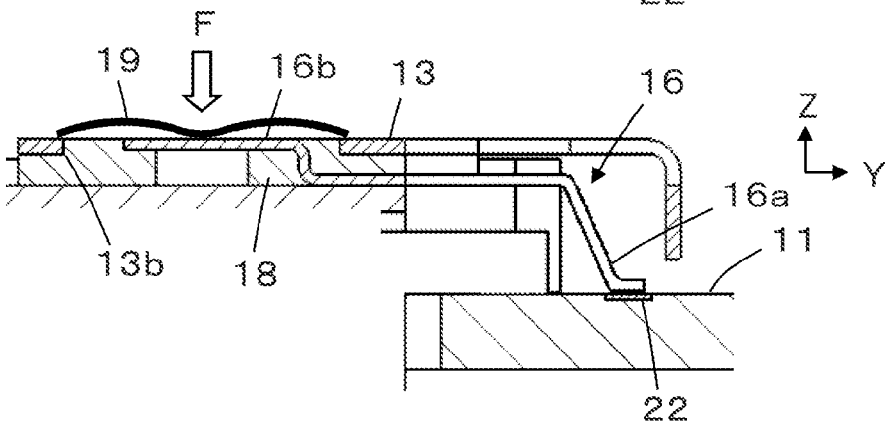
FIG. 7B is a partially enlarged cross-sectional view illustrating the connector of Embodiment 1, in which the press button switch is in the ON state.

The operation of the press button switch as constituted of the outer shell 13, the switch contact 16 and the switch member 19 is explained referring to FIGS. 7A and 7B showing the main part of the connector in an enlarged manner. In FIGS. 7A and 7B, for the purpose of simplicity, the insulator seal 17 covering the switch member 19 is omitted.

Firstly, as illustrated in FIG. 7A, under a situation where no force is applied to the dome shaped switch member 19, the switch member 19 is separated from the switch contact portion 16*b* of the switch contact 16, and the switch member 19 and the switch contact 16 are electrically disconnected from each other. That is, the press button switch is in the OFF state.

Secondly, as illustrated in FIG. 7B, when force F is applied to the switch member 19 to press down the upper part of the switch member 19 in the −Z direction, that is, toward the outer shell 13 to cause the switch member 19 to be deformed until the lower surface of the central part of the switch member 19 comes into contact with the switch contact portion 16*b* of the switch contact 16, the switch contact 16 is connected to the outer shell 13 through the switch member 19, and the switch pad 22 of the substrate 11, to which the substrate-mounting portions 16*a* of the switch contact 16 are fixed, has the same ground potential as the outer shell 13. That is, the press button switch reaches the ON state. Therefore, a not shown detecting circuit, if connected to the switch pad 22, can detect pressing down of the switch member 19 based on the fact that the switch pad 22 has the ground potential.

It should be noted that, when the force F depressing the upper part of the switch member 19 toward the outer shell 13 is removed, the switch member 19 is restored to the state illustrated in FIG. 7A automatically by its own elasticity, and the press button switch returns to the OFF state.

In the connector according to Embodiment 1, a press button switch is formed by: disposing the switch contact portion 16*b* of the switch contact 16 in the opening 13*b* formed in the outer shell 13 which covers the upper part the connector housing 12; covering the opening 13*b* with the elastically deformable dome shaped switch member 19 formed of a conductive material; and connecting the switch member 19 to the outer shell 13 in the periphery of the opening 13*b*, so that it is possible to integrate a tactile switch consisting of a press button switch into the connector while minimizing the size of the connector, especially the height thereof. As a result, incorporation of the connector and the tactile switch into electronic devices becomes simple and easy.

In addition, since the switch contact support member 18 is molded by insert molding along with the outer shell 13 and the switch contact 16 and, in consequence, the periphery of the opening 13*b* of the outer shell 13 and the switch contact portion 16*b* of the switch contact 16 are located on the same plane, the distance from the top of the dome shaped switch member 19, which is so disposed as to cover the opening 13*b*, to the switch contact portion 16*b* is made stable, allowing a press button switch of high reliability.

Embodiment 2

Figure 8:
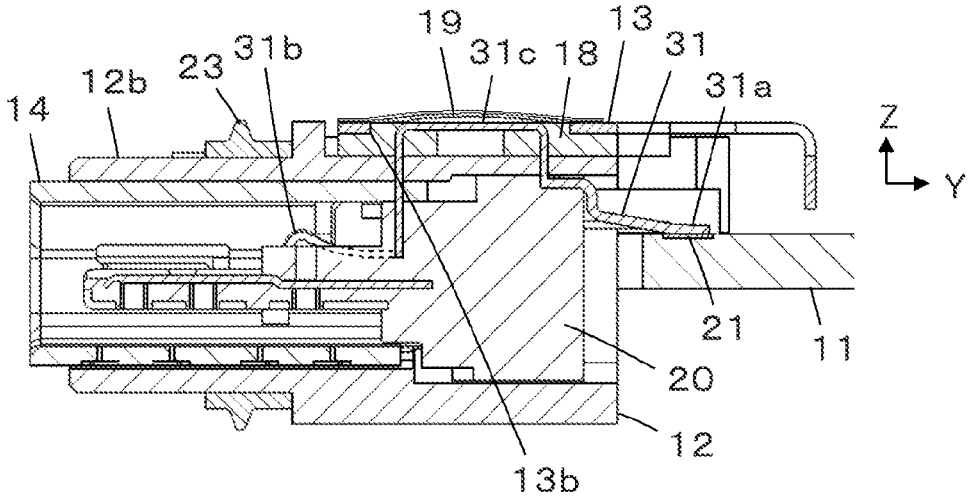
FIG. 8 is a cross-sectional view illustrating a connector according to Embodiment 2.
Figure 9:
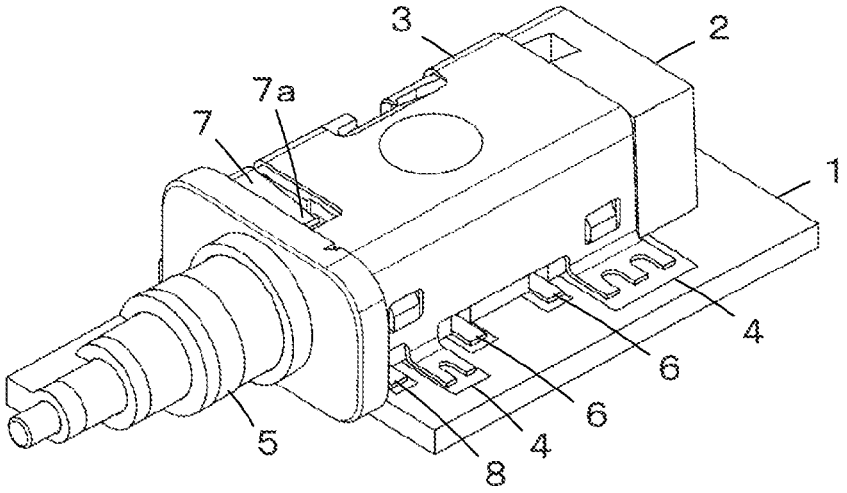
FIG. 9 is a perspective view illustrating a configuration of a prior art connector.
Figure 10:
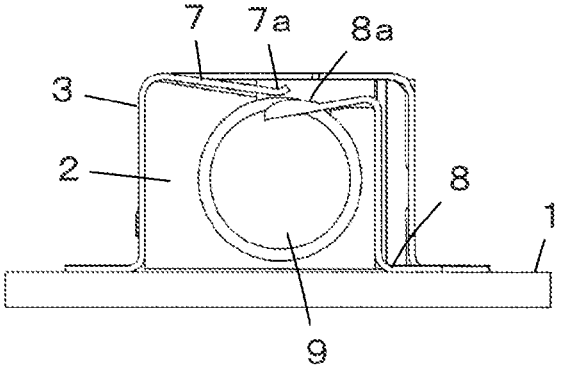
FIG. 10 is a cross-sectional view illustrating a prior art connector.

A connector according to Embodiment 2 is illustrated in FIG. 8. Instead of using the switch contact 16 which is independent of the signal contacts 15 and is dedicated to the press button switch, as in the connector according to Embodiment 1, this connector uses one signal contact out of the plural signal contacts 15 and makes the signal contact serve as a switch contact 31 also.

Specifically, the switch contact 31 has a substrate-mounting portion 31*a* which is formed at the +Y direction end, a connector contact portion 31*b* which is formed at the −Y direction end, and a switch contact portion 31*c* which is formed in a middle section between the substrate-mounting portion 31*a* and the connector contact portion 31*b*. The substrate-mounting portion 31*a* is connected by soldering to the corresponding signal pad 21 of the substrate 11, similarly to the substrate-mounting portions 15*a* of other signal contacts 15. The connector contact portion 31*b*, together with the connector contact portions 15*b* of other signal contacts 15, is arranged in the X direction inside the mating connector receiving portion 12*b* of the connector housing 12. Similar to the switch contact portion 16*b* of the switch contact 16 in Embodiment 1, the switch contact portion 31*c* is formed in the shape of a circle smaller in diameter than the opening 13*b* of the outer shell 13, is located on the same plane as the periphery of the opening 13*b* of the outer shell 13 and the exposed part of the switch contact support member 18, and is disposed directly under the switch member 19.

If a not shown detecting circuit is connected to the signal pad 21 to which the substrate-mounting portion 31*a* of the switch contact 31 is connected by soldering, depressing of the switch member 19 can be detected based on the fact that the signal pad 21 has the ground potential.

In addition, since the connector contact portion 31*b* is connected to the switch contact portion 31*c*, when a not shown mating connector is inserted in the mating connector receiving portion 12*b* of the connector housing 12 and the connector is in a state of being fitted to the mating connector, depressing of the switch member 19 can be detected even on an external apparatus connected to the mating connector, based on the fact that the connector contact portion 31*b* has the ground potential.

When the connector according to Embodiment 1 or 2 is incorporated into an electronic device, the switch area 17*a* of the insulator seal 17 as attached onto the switch member 19 may be exposed to outside directly from the electronic device. Alternatively, a press button may be mounted on a housing of the electronic device in a position directly above the switch area 17*a* of the insulator seal 17 so that the operator can press the press button to depress the switch member 19.

While Embodiments 1 and 2 as above, in which the waterproofing member 23 is disposed in the outer periphery of the tubular mating connector receiving portion 12*b* of the connector housing 12, are suitable for waterproofed electronic devices, the waterproofing member 23 may be omitted if waterproofing is not necessary.

What is claimed is:

1. A connector comprising:

a connector housing having a mating connector receiving portion adapted to receive a mating connector;

a plurality of signal contacts each having a connector contact portion formed at one end thereof and disposed in the mating connector receiving portion of the connector housing;

a metal shell disposed to cover at least the connector contact portion of each of the plurality of signal contacts;

a switch contact having a switch contact portion formed thereon; and a switch member formed of a conductive material, connected to the metal shell, and disposed facing the switch contact portion of the switch contact, the switch member being deformed, when pressed, to come into contact with the switch contact portion of the switch contact and thereby bring the switch contact into conduction with the metal shell, wherein the metal shell, the switch contact, and the switch member constitute a press button switch.

2. The connector according to claim 1, wherein the metal shell has an inner shell disposed in the mating connector receiving portion of the connector housing and covering the connector contact portion of each of the plurality of signal contacts, and an outer shell disposed outside the connector housing and connected to the inner shell, and wherein the switch member is connected to the outer shell.

3. The connector according to claim 2, wherein the switch contact portion of the switch contact is disposed inside an opening formed in the outer shell, and wherein the switch member has a shape of a dome covering the opening of the outer shell, and is connected to the outer shell in a periphery of the opening.

4. The connector according to claim 3, further comprising an insulator seal adapted to cover a vicinity of the opening of the outer shell and the switch member.

5. The connector according to claim 3, further comprising a switch contact support member formed of an insulating resin and adapted to support the switch contact and to be fixed to the outer shell.

6. The connector according to claim 5, wherein the switch contact support member is molded by insert molding along with the outer shell and the switch contact.

7. The connector according to claim 3, wherein the switch contact portion of the switch contact and the periphery of the opening of the outer shell are located approximately on a same plane.

8. The connector according to claim 2, wherein the connector housing is fixed on a substrate, and the inner shell and the outer shell are connected to each other and electrically grounded through a grounding pattern formed on a surface of the substrate.

9. The connector according to claim 8, wherein the switch contact has the switch contact portion formed at one end thereof and a substrate-mounting portion formed at another end thereof, and the substrate-mounting portion is connected to a switch pad formed on the surface of the substrate.

10. The connector according claim 1, wherein the switch contact is formed by one signal contact out of the plurality of signal contacts.

* * * * *